US011428501B2

(12) United States Patent
Tanaka et al.

(10) Patent No.: US 11,428,501 B2
(45) Date of Patent: Aug. 30, 2022

(54) INTERCHANGEABLE GRIP FOR A FIREARM

(71) Applicants: Shaun Tanaka, Sherman Oaks, CA (US); Joshua Pratt, Napa, CA (US)

(72) Inventors: Shaun Tanaka, Sherman Oaks, CA (US); Joshua Pratt, Napa, CA (US)

(73) Assignee: Shaun Tanaka, Sherman Oaks (CA)

( * ) Notice: Subject to any disclaimer, the term of this patent is extended or adjusted under 35 U.S.C. 154(b) by 0 days.

(21) Appl. No.: 17/144,882

(22) Filed: Jan. 8, 2021

(65) Prior Publication Data

US 2022/0221246 A1 Jul. 14, 2022

(51) Int. Cl.
*F41C 23/16* (2006.01)
*F41C 23/10* (2006.01)

(52) U.S. Cl.
CPC ..... *F41C 23/16* (2013.01); *F41C 23/10* (2013.01)

(58) Field of Classification Search
CPC ..... F41C 23/16; F41C 23/10
See application file for complete search history.

(56) References Cited

U.S. PATENT DOCUMENTS 4,300,302 A * 11/1981 Anschutz ..... F41C 23/14 42/73
4,502,238 A * 3/1985 Farrar ..... F41C 7/02 42/72
5,722,195 A * 3/1998 Bentley ..... F41C 23/10 42/1.06
7,665,240 B1 * 2/2010 Bentley ..... F41C 23/20 42/72
8,205,371 B1 * 6/2012 Cook ..... F41A 25/10 42/1.06
8,752,323 B2 * 6/2014 Fulton ..... F41C 23/14 42/73
9,200,867 B1 * 12/2015 Swan ..... F41C 23/16
9,441,910 B1 * 9/2016 Fogoros ..... F41C 23/14
9,476,672 B2 * 10/2016 Wells ..... F41G 11/003
9,599,429 B1 * 3/2017 Davis ..... F41C 23/16
9,599,430 B1 * 3/2017 Geissele ..... F41C 23/16
9,651,325 B1 * 5/2017 Gant ..... F41C 23/16
10,527,387 B1 * 1/2020 Oliva Chavez ..... F41C 23/16
11,162,758 B1 * 11/2021 Lee ..... F41C 23/10
(Continued)

*Primary Examiner* — Michelle Clement
(74) *Attorney, Agent, or Firm* — Fitch, Even, Tabin & Flannery, LLP

(57) ABSTRACT

Methods, systems, and apparatuses for interchangeable, customizable, and suitable grips for firearms are described. In some embodiments, the grip includes two components, a grip base piece and an interchangeable grip (e.g., an interchangeable grip attachment) of the firearm user's choice. The grip base piece attaches to the lower receiver held by a pistol grip screw and a lock washer. In some examples, the grip base piece may only be installed once, for example, initially prior to implementation of interchangeable grips (e.g., the grip base piece may not require any other attention or installation changes after the initial placement onto the lower receiver). Following the installation of the grip base piece on the lower receiver, interchangeable grips of users' choice may be connected to the grip base piece (e.g., and interchanged with other interchangeable grips) via utilizing a grip interface (e.g., a T-shaped mating tab of the interchangeable grip).

8 Claims, 13 Drawing Sheets

(56) References Cited

U.S. PATENT DOCUMENTS

| | | | | |
|---|---|---|---|---|
| 2003/0140542 | A1* | 7/2003 | Kay | F41C 23/20 42/75.03 |
| 2005/0241206 | A1* | 11/2005 | Teetzel | F41A 23/08 42/72 |
| 2006/0048424 | A1* | 3/2006 | Weir | F41C 23/12 42/69.01 |
| 2006/0064913 | A1* | 3/2006 | Gablowski | F41C 23/16 42/72 |
| 2009/0313873 | A1* | 12/2009 | Roth | F41C 23/16 42/72 |
| 2010/0031551 | A1* | 2/2010 | Griffin | F41C 23/16 42/72 |
| 2011/0035981 | A1* | 2/2011 | Bentley | F41C 27/22 42/1.06 |
| 2013/0239450 | A1* | 9/2013 | Michel | F41C 23/14 29/434 |
| 2013/0333263 | A1* | 12/2013 | Hovey | F41C 23/16 42/72 |
| 2014/0033593 | A1* | 2/2014 | Moore, Jr. | F41C 23/16 42/90 |
| 2015/0198408 | A1* | 7/2015 | Kincel | F41C 23/16 42/72 |
| 2016/0003576 | A1* | 1/2016 | Spykerman | F41C 23/10 42/73 |
| 2016/0313095 | A1* | 10/2016 | Gosson | F41B 9/0071 |
| 2017/0219306 | A1* | 8/2017 | Murphy, II | F41A 17/20 |
| 2020/0041226 | A1* | 2/2020 | Grenier | F41C 23/14 |
| 2020/0096288 | A1* | 3/2020 | Geissele | F41G 11/003 |
| 2020/0149841 | A1* | 5/2020 | Bonesteel | F41G 11/003 |
| 2020/0363151 | A1* | 11/2020 | Murphy, II | F41C 23/10 |

* cited by examiner

INTERCHANGEABLE GRIP FOR A FIREARM

BACKGROUND OF THE INVENTION

1. Field of the Invention

The present invention relates generally to firearms, and more specifically to interchangeable grips for firearms.

2. Discussion of the Related Art

Various systems and processes are known in the art for interchangeable grips for firearms.

A firearm is a weapon designed to shoot projectiles (e.g., bullets). Firearms may include many functional components such as a grip, a trigger, a firing pin, a barrel, etc.

Conventional processes for removing or replacing a grip on a firearm often requires tools, is tedious, and is time-consuming. Furthermore, the grips that are included on firearms may often be intended as a universal or "one size fits all" grip, which is inherently not true due to differences in firearm users' hand sizes, hand shapes, etc. Without a grip suitable for fitting a particular user's hand size, hand shape, grip strength, etc., firearm users may have less control of their firearm which may result in inaccurate shooting, fatal accidents, etc.

SUMMARY

An apparatus, system, and method for interchangeable grips for firearms are described. Embodiments of the apparatus, system, and method include a grip base piece comprising a receiver interface and a grip base interface, wherein the grip base piece is configured to couple to a firearm receiver, wherein the receiver interface comprises a base shape configured to couple to a corresponding receiver shape at a firearm grip mounting location, wherein the corresponding receiver shape at the firearm grip mounting location is part of the firearm receiver, and wherein the grip base interface comprises a recess and an interchangeable grip comprising a grip interface, a grip body, a pin, and a spring, wherein the grip interface is configured to couple to the grip base interface, wherein the grip interface comprises a grip interface shape configured to couple to a corresponding grip base piece shape at a grip mounting location, wherein the grip interface shape at the grip mounting location is part of the grip interface of the grip base piece, wherein the interchangeable grip is selectively slidable at the grip interface relative to the grip base interface to release the interchangeable grip from the grip base piece, wherein the grip body comprises a pin-guide, wherein the pin is disposed within the pin-guide, wherein the pin protrudes into the recess of the grip base interface temporarily preventing sliding of the grip interface relative to the grip base interface, wherein the spring is interposed between the grip body and the pin, wherein the spring holds the pin in a first position protruding into the recess, and wherein deflecting the spring allows the pin into a second position, removes the pin from the recess, and permits selective sliding of the interchangeable grip from the grip base piece.

A method, apparatus, and system for interchangeable grips for firearms are described. Embodiments of the method, apparatus, and system are configured to move a pin from a first position to a second position within a pin-guide of a interchangeable grip, wherein in a first position the pin protrudes into a recess of a grip base interface temporarily preventing sliding of a grip interface relative to the grip base interface, and wherein in the second position a spring is deflected to remove the pin from the recess, and permit selective sliding of the interchangeable grip from a grip base piece and slide the interchangeable grip from the grip base piece to release the interchangeable grip from the grip base piece.

An apparatus, system, and method for interchangeable grips for firearms are described. Embodiments of the apparatus, system, and method include a grip base piece comprising a receiver interface and a grip base interface, wherein the receiver interface is configured to couple to a firearm receiver, wherein the receiver interface comprises a base shape configured to couple to a corresponding receiver shape at a firearm grip mounting location, wherein the corresponding receiver shape at the firearm grip mounting location is part of the firearm receiver, and wherein the grip base interface comprises a recess and a trigger lock comprising a trigger lock interface, a trigger lock body, a trigger lock pin, and a pair of cover plates, wherein the trigger lock interface is configured to couple to the grip base interface, wherein the trigger lock interface comprises a grip interface shape configured to couple to a corresponding grip base piece shape at a grip mounting location, wherein the grip interface shape at the grip mounting location is part of the trigger lock interface of the grip base piece, wherein the trigger lock is selectively slidable at the trigger lock interface relative to the grip base interface to release the trigger lock from the grip base piece, wherein the trigger lock body comprises a trigger lock pin-guide, wherein the trigger lock pin is disposed within the trigger lock pin-guide, wherein the trigger lock pin protrudes into the recess of the grip base interface temporarily preventing sliding of the trigger lock interface relative to the grip base interface, wherein the pair of cover plates extend above the trigger lock body and forward over a trigger space, wherein one of the pair is positioned on a left side of the trigger space, and another of the pair is positioned on a right side of the trigger space, and wherein access to the trigger space is limited by the pair of cover plates.

DETAILED DESCRIPTION

Figure 1:
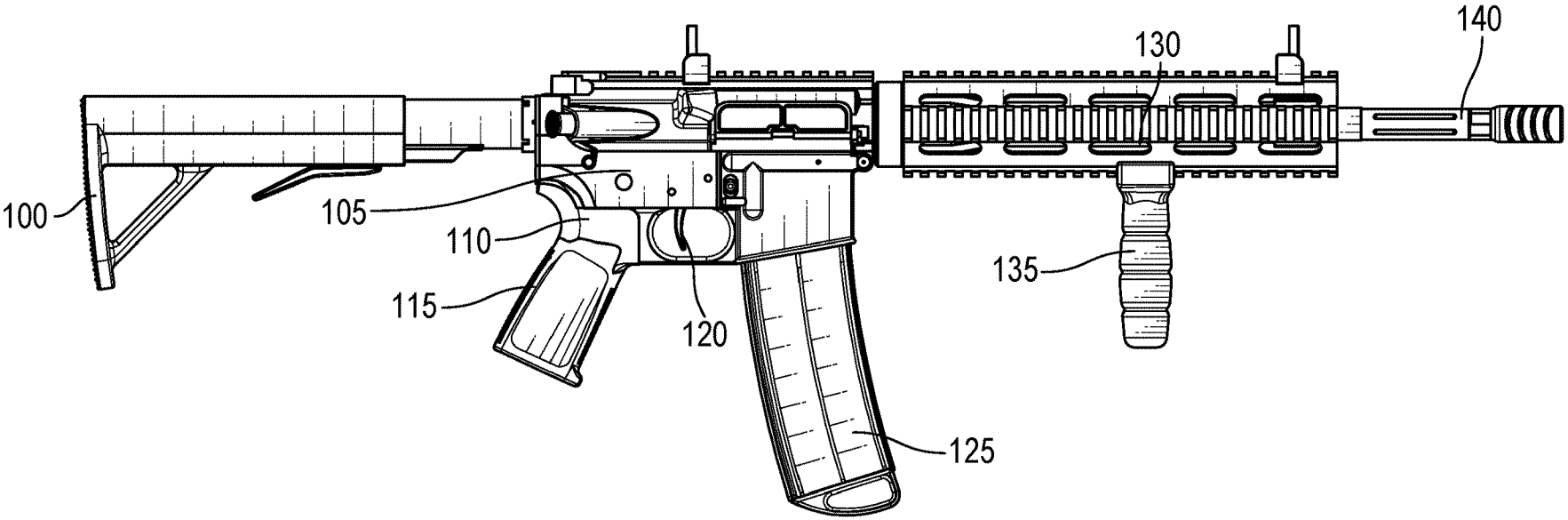
FIG. 1 shows an example of a firearm according to aspects of the present disclosure.

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

As described herein, processes for removing a grip on a firearm often requires tools, are tedious, and are time-consuming. Due to the difficult nature of removing a grip, a user may be dissuaded from switching to a more fitting grip to accommodate other firearm users. In various examples (e.g., when firearm users share a firearm at the firing range, when a parent is sharing a firearm with a child, etc.), differences in hand size may be considerable in terms of safety. As another example, in an armory, ideally, parts need to be interchangeable and replaceable in a timely manner. However, most armorers trade personalization for ease of interchangeability because there is currently not a product that enables not only quickness and ease but also personalized interchangeability as well. For even advanced firearm users, a non-suitable grip size can decrease accuracy due to an improper distance for the index finger to pull the trigger and impair recoil control when the firearm user's fingers are not seated properly. High-stress situations cause firearm users to sweat causing the grip to slip making grip size, ergonomics, and material composition all the more important. In a self-defense, combat, or competition situation, problems with grips can be particularly dangerous and should not be an area that detracts a firearm user's focus.

Some customizable grip solutions include modifying the grip to be adjustable in distance from the trigger or foldable at the base to adjust to various angles. However, these solutions have only alleviated part of singular problems to an extent while failing to incorporate interchangeability, quickness, ease, compatibility, installation without specialized tools, customizable ergonomics, and adaptability to diverse applications. Therefore, there exists a desire for a solution to the multifaceted problem of non-suitable grips.

Embodiments of the present disclosure provides for interchangeable firearm grips and techniques for firearm grip interchangeability that are quick, easy, compatible, effective in combating recoil, able to be installed without specialized tools, customizable, ergonomic, personalized, and adaptable.

One skilled in the art will appreciate that some elements in the figures may be illustrated for simplicity and clarity and have not necessarily been drawn to Scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

FIG. 1 shows an example of a firearm according to aspects of the present disclosure. The example shown includes stock 100, receiver 105, grip base piece 110, interchangeable grip 115, trigger 120, magazine 125, rail 130, foregrip 135, and barrel 140.

FIG. 1 shows an example of an assembled firearm. Embodiments described herein provide an interchangeable, customizable, and suitable grip for any firearm user. In some embodiments, the grip includes two components. The grip may include a grip base piece 110 as well as an interchangeable grip 115 (e.g., an interchangeable grip attachment) of the firearm user's choice. The grip base piece 110 attaches to the lower receiver 105 and may be held by a pistol grip screw and a lock washer. In some examples, the grip base piece 110 may only be installed once, for example, initially prior to implementation of interchangeable grips 115 (e.g., the grip base piece 110 may not require any other attention or installation changes after the initial placement onto the lower receiver 105).

Stock 100 is an example of, or includes aspects of, the corresponding element described with reference to FIGS. 8 and 9. Receiver 105 is an example of, or includes aspects of, the corresponding element described with reference to FIGS. 2-4, and 8-12. Grip base piece 110 is an example of, or includes aspects of, the corresponding element described with reference to FIGS. 2-12. Interchangeable grip 115 is an example of, or includes aspects of, the corresponding element described with reference to FIGS. 2, and 4-9. Trigger 120 is an example of, or includes aspects of, the corresponding element described with reference to FIGS. 8 and 9. Magazine 125 is an example of, or includes aspects of, the corresponding element described with reference to FIGS. 8 and 9. Rail 130 is an example of, or includes aspects of, the corresponding element described with reference to FIGS. 8 and 9. Foregrip 135 is an example of, or includes aspects of, the corresponding element described with reference to FIG. 8. Barrel 140 is an example of, or includes aspects of, the corresponding element described with reference to FIGS. 8 and 9.

Figure 2:
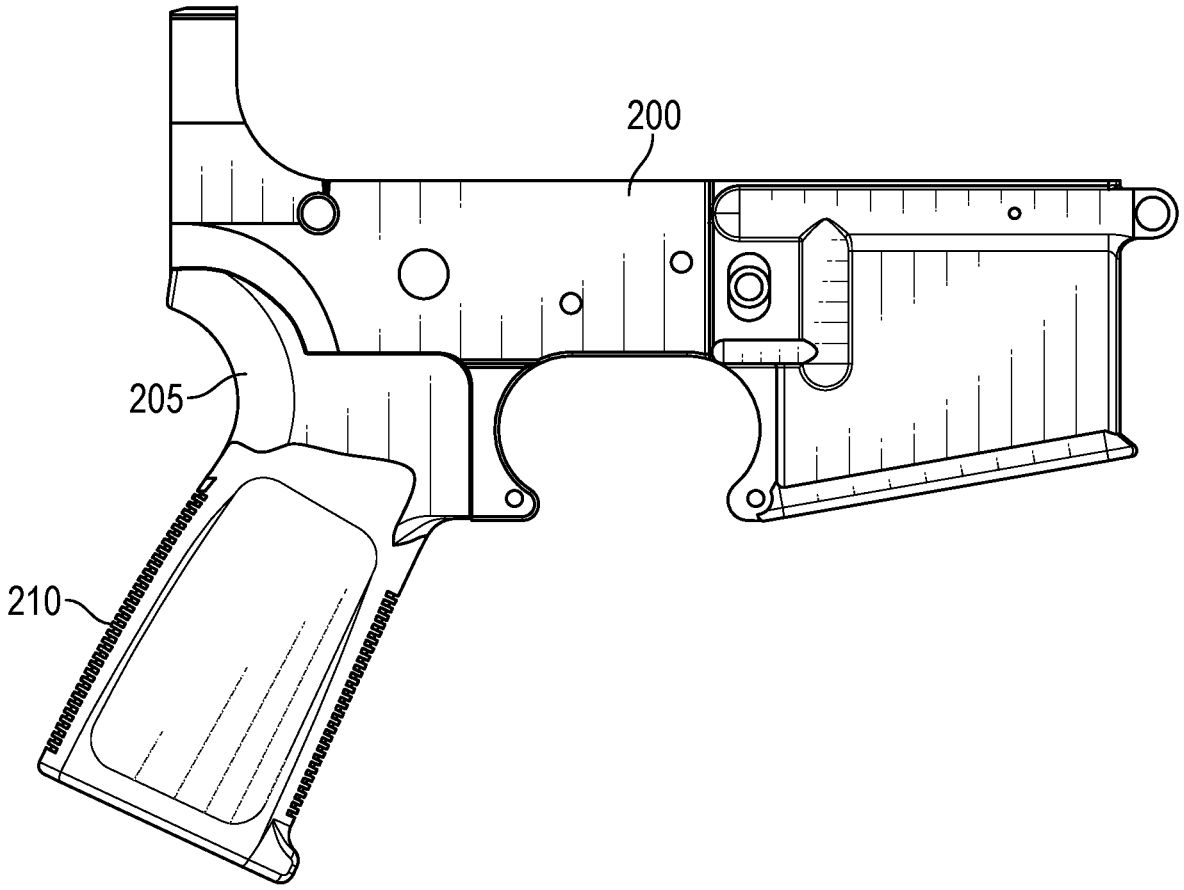
FIG. 2 shows an example of a receiver, a grip base piece, and an interchangeable grip according to aspects of the present disclosure.

FIG. 2 shows an example of a receiver 200, a grip base piece 205, and an interchangeable grip 210 according to aspects of the present disclosure. The example shown includes receiver 200, grip base piece 205, and interchangeable grip 210. FIG. 2 shows where a grip (e.g., a grip base piece 205 and an interchangeable grip 210) may be attached to a lower receiver 200.

A grip base piece 205 includes a receiver interface and a grip base interface, where the grip base piece 205 is configured to couple to a firearm receiver 200, where the receiver interface includes a base shape configured to couple to a corresponding receiver shape at a firearm grip mounting location, where the corresponding receiver shape at the firearm grip mounting location is part of the firearm receiver 200, and where the grip base interface includes a recess.

An interchangeable grip 210 includes a grip interface, a grip body, a pin, and a spring. In some embodiments, the grip interface is configured to couple to the grip base interface. An interchangeable grip 210 includes a grip interface, a grip body, a pin, and a spring. In some embodiments, the grip interface is configured to couple to the grip base interface. In some embodiments, the grip interface includes a grip interface shape configured to couple to a corresponding grip base piece shape at a grip mounting location. In some embodiments, the grip interface shape at the grip mounting location is part of the grip interface of the grip base piece 205. The grip body includes a pin-guide, where the pin is disposed within the pin-guide, where the pin protrudes into the recess of the grip base interface temporarily preventing sliding of the grip interface relative to the grip base interface.

Receiver 200 is an example of, or includes aspects of, the corresponding element described with reference to FIGS. 1, 3, 4, and 8-12. Grip base piece 205 is an example of, or includes aspects of, the corresponding element described with reference to FIGS. 1, and 3-12. Interchangeable grip 210 is an example of, or includes aspects of, the corresponding element described with reference to FIGS. 1, and 4-9.

Figure 3:
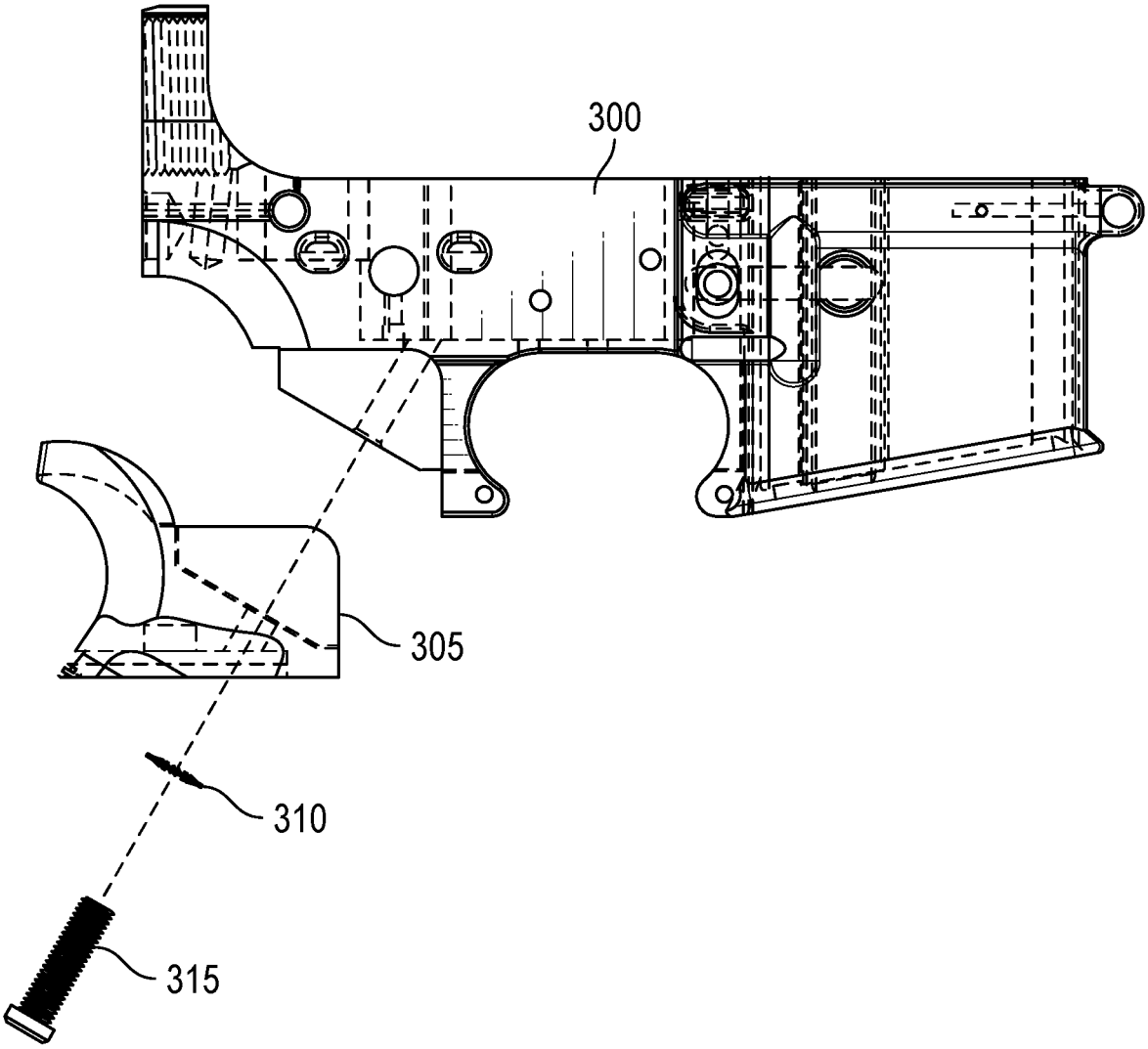
FIG. 3 shows an example of attachment of a grip base piece according to aspects of the present disclosure.

FIG. 3 shows an example of attachment of a grip base piece 305 according to aspects of the present disclosure. The example shown includes receiver 300, grip base piece 305, washer 310, and fastener 315.

FIG. 3 is a view illustrating the attachment of the grip base piece 305 to the lower receiver 300 secured by a fastener 315 (e.g., a pistol grip screw) and lock washer 310. The grip base piece 305 attaches to the lower receiver 300 via a fastener 315 (e.g., a bolt, a pistol grip screw, etc.) and a lock washer 310. For instance, in some embodiments, the grip base piece 305 includes a mounting hole adapted to receive a fastener 315 that couples the grip base piece 305 to the firearm receiver 300. In some embodiments, a lock washer 310 may encircle the fastener 315, where the lock washer 310 is interposed between the fastener 315 and the grip base piece 305.

Receiver 300 is an example of, or includes aspects of, the corresponding element described with reference to FIGS. 1, 2, 4, and 8-12. Grip base piece 305 is an example of, or includes aspects of, the corresponding element described with reference to FIGS. 1, 2, and 4-12.

Figure 4:
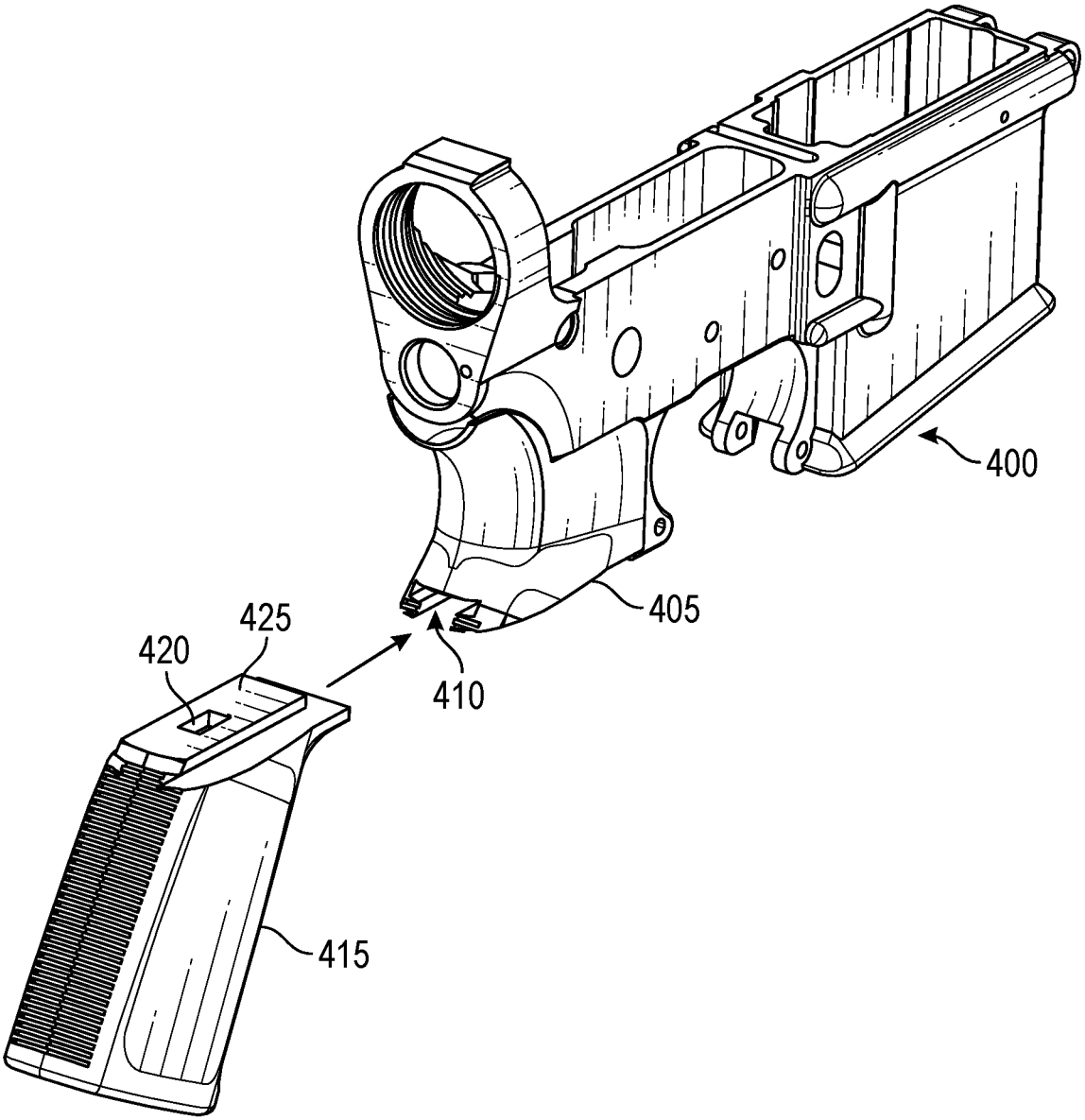
FIG. 4 shows an example of attachment of an interchangeable grip according to aspects of the present disclosure.

FIG. 4 shows an example of attachment of an interchangeable grip 415 according to aspects of the present disclosure. The example shown includes receiver 400, grip base piece 405, and interchangeable grip 415.

Following the installation of the grip base piece 405 on the lower receiver 400, the interchangeable grip 415 of choice may be connected to the grip base piece 405 (e.g., and interchanged with other interchangeable grips 415) via utilizing a grip interface 425 (e.g., a T-shaped mating tab of the interchangeable grip 415). For installation, the interchangeable grip 415 may be slid through a grip base interface 410 (e.g., a T-shaped channel) towards the barrel or front of the firearm. Such interchangeable installation may be performed with various interchangeable grips 415.

Figure 5:
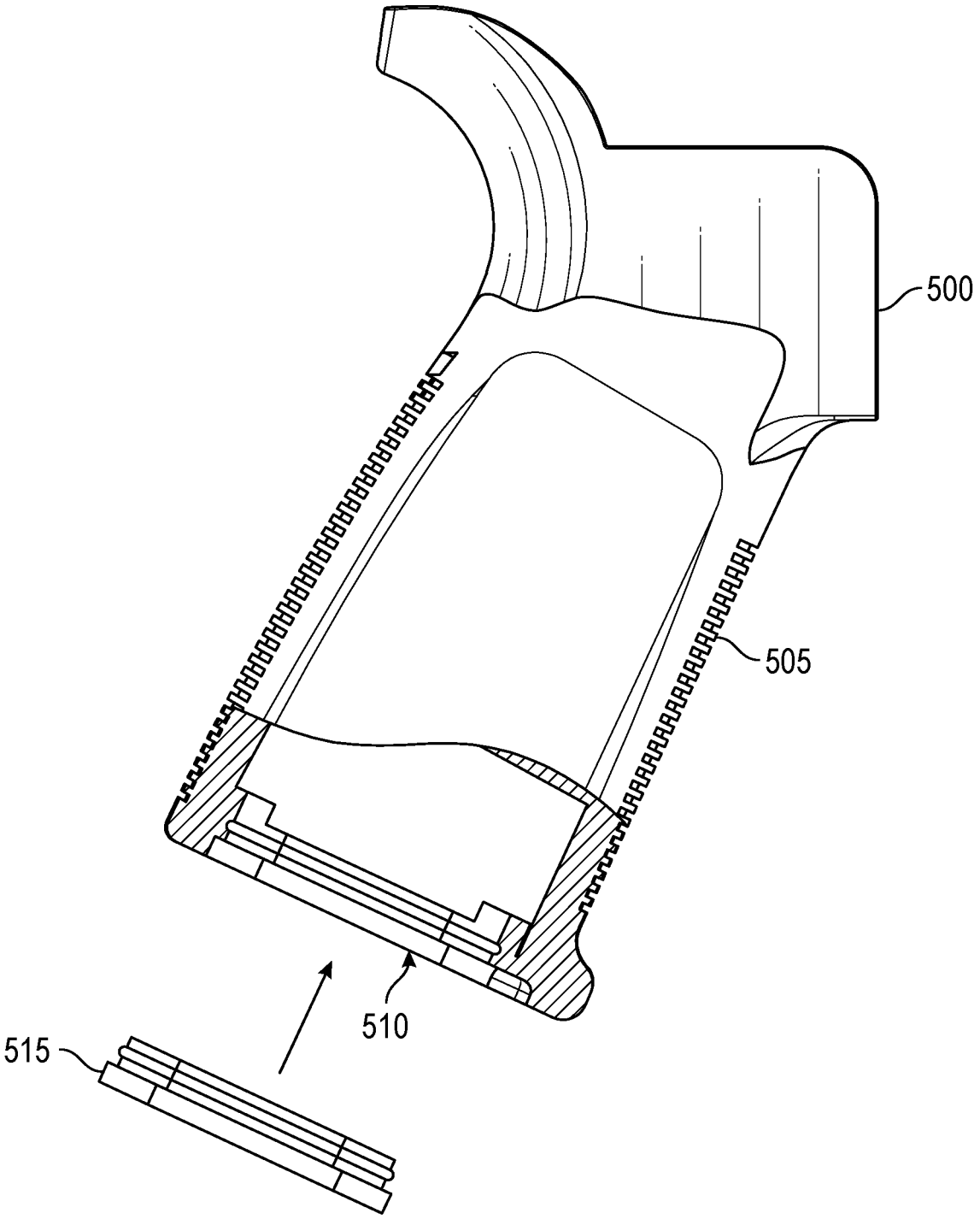
FIG. 5 shows an example of a grip base piece and an interchangeable grip according to aspects of the present disclosure.

In order to interchange interchangeable grips 415, an attached interchangeable grip 415 may be removed by first opening a grip cap (e.g., as further described herein, for example, with reference to FIG. 5). A pull release tab may then be pulled which disengages the spring-loaded rod from the grip base piece 405, allowing the interchangeable grip 415 to slide off the grip base piece 405 (e.g., as further described herein, for example, with reference to FIG. 6). For removal of the interchangeable grip 415 from the grip base piece 405, the interchangeable grip 415 may be slid towards the stock or rear of the firearm. After the two components are separated, the grip cap on the interchangeable grip 415 may be closed (e.g., attached back to the bottom of the interchangeable grip 415) to prevent debris from entering the internals of the component.

In order to interchange interchangeable grips 415, an attached interchangeable grip 415 may be removed by first opening the grip cap. The pull release tab may then be pulled which disengages the spring-loaded rod from the grip base piece 405, allowing the interchangeable grip 415 to slide off the grip base piece 405. For removal of the interchangeable grip 415 from the grip base piece 405, the interchangeable grip 415 may be slid towards the stock or rear of the firearm. After the two components are separated, the grip cap on the interchangeable grip 415 may be closed (e.g., attached back to the bottom of the interchangeable grip 415) to prevent debris from entering the internals of the component.

A grip base piece 405 includes a receiver interface (e.g., an interface to attach to receiver 400) and a grip base interface 410, where the grip base piece 405 is configured to couple to a firearm receiver 400, where the receiver interface includes a base shape configured to couple to a corresponding receiver shape at a firearm grip mounting location, where the corresponding receiver shape at the firearm grip mounting location is part of the firearm receiver 400, and where the grip base interface 410 includes a recess.

An interchangeable grip 415 includes a grip interface 425, a grip body, a pin, and a spring. In some embodiments, the grip interface 425 is configured to couple to the grip base interface 410. In some embodiments, the grip interface 425 includes a grip interface shape configured to couple to a corresponding grip base piece shape at a grip mounting location. In some embodiments, the grip interface shape at the grip mounting location is part of the grip interface 425 of the grip base piece 405. In some embodiments, the interchangeable grip 415 is selectively slidable at the grip interface 425 relative to the grip base interface 410 to release the interchangeable grip 415 from the grip base piece 405. In some embodiments, the grip body includes a pin-guide 420, where the pin is disposed within the pin-guide 420, where the pin protrudes into the recess of the grip base interface 410 temporarily preventing sliding of the grip interface 425 relative to the grip base interface 410. In some embodiments, the spring is interposed between the grip body and the pin, where the spring holds the pin in a first position protruding into the recess, and where when the spring is deflected allows the pin into a second position, removing the pin from the recess, and permitting selective sliding of the interchangeable grip 415 from the grip base piece 405.

In some embodiments, the grip interface 425 includes a T-shaped cross section and the grip base interface 410 includes a T-shaped cross section. In some embodiments, the grip interface 425 includes a T-shaped cross section of a T-shaped rail extending away from the grip body and the grip base interface 410 includes a T-shaped cross section of a T-shaped channel in the grip base piece 405.

Embodiments of the present disclosure also provide a quick removal method for a grip (e.g., an interchangeable grip 415) for a firearm. The quick removal method includes moving a pin from a first position (e.g., as described in more detail herein, for example, with reference to FIG. 7) to a second position (e.g., as described in more detail herein, for example, with reference to FIG. 6) within a pin guide of a interchangeable grip 415, where in a first position the pin protrudes into a recess of a grip base interface 410 temporarily preventing sliding of a grip interface 425 relative to the grip base interface 410, and where in the second position a spring is deflected to remove the pin from the recess, and permit selective sliding of the interchangeable grip 415 from a grip base piece 405. The quick removal method also includes sliding the interchangeable grip 415 from the grip base piece 405 to release the interchangeable grip 415 from the grip base piece 405.

In some embodiments, the quick removal method includes moving by the spring of the pin from the second position within the pin guide. In some embodiments, the quick removal method includes mounting the grip base piece 405 to a firearm receiver 400 at a grip mounting location, where the grip base interface 410 is part of the grip base piece 405. In some examples, the moving of the pin includes moving a release with a force applied to the release that results in deflection of the spring and movement of the pin into the second position. In some examples, the moving of the pin includes removing a cover from a lower cavity of a grip body before moving the release. In some examples, the moving of the release includes moving a ring coupled to a flexible cable, where the flexible cable is coupled at a proximal end to the ring and is coupled at a distal end to the pin.

Embodiments of the present disclosure also provide a quick attachment method for a grip (e.g., an interchangeable grip 415) for a firearm. The method includes sliding an interchangeable grip 415 (e.g., another interchangeable grip 415) into the grip base piece 405 to engage the interchangeable grip 415 with the grip base piece 405. The attachment of another interchangeable grip 415 may include moving by another spring of another pin from the second position to the first position within another pin guide to temporarily prevent sliding of another grip interface 425 relative to the grip base interface 410. In some embodiments, the sliding includes sliding of the grip interface 425 relative to the grip base interface 410. In some embodiments, the grip interface 425 and the grip base interface 410 form a T-shaped cross section. In some embodiments, the sliding of the quick attachment method includes sliding a T-shaped rail extending away from a grip body and sliding a T-shaped channel in the grip base piece 405, the T-shaped rail being mated with the T-shaped channel. In some examples, the quick attachment method includes mounting the grip base piece 405 to a firearm receiver 400 at a grip mounting location, where the grip base interface 410 is part of the grip base piece 405 (e.g., mounting the grip base piece 405 to a firearm receiver 400 by inserting a fastener through a mounting hole in the grip base piece 405 and into the firearm receiver 400).

Receiver 400 is an example of, or includes aspects of, the corresponding element described with reference to FIGS. 1-3, and 8-12. Grip base piece 405 is an example of, or includes aspects of, the corresponding element described with reference to FIGS. 1-3, and 5-12. In one embodiment, grip base piece 405 includes grip base interface 410. Grip base interface 410 is an example of, or includes aspects of, the corresponding element described with reference to FIG. 12. Interchangeable grip 415 is an example of, or includes aspects of, the corresponding element described with reference to FIGS. 1, 2, and 5-9. In one embodiment, interchangeable grip 415 includes pin-guide 420 and grip interface 425.

FIG. 5 shows an example of a grip base piece 500 and an interchangeable grip 505 according to aspects of the present disclosure. The example shown includes grip base piece 500 and interchangeable grip 505.

In some examples, to slide an interchangeable grip 505 into place, a grip cap 515 may be opened to access a pull release tab. After usage of a pull release tab (e.g., as further described with reference to FIGS. 6 and 7) a user may close the grip cap 515 to prevent accidental disengagement of the pull-release tab.

In some embodiments, the grip body includes a lower cavity 510 and a release (e.g., a release tab, a ring coupled to a flexible cable, etc.). In some embodiments, the grip body further includes a grip cap 515 adapted to removably cover the lower cavity 510. Grip base piece 500 is an example of, or includes aspects of, the corresponding element described with reference to FIGS. 1-4, and 6-12. Interchangeable grip 505 is an example of, or includes aspects of, the corresponding element described with reference to FIGS. 1, 2, 4, and 6-9. In one embodiment, interchangeable grip 505 includes lower cavity 510 and grip cap 515.

Figure 6:
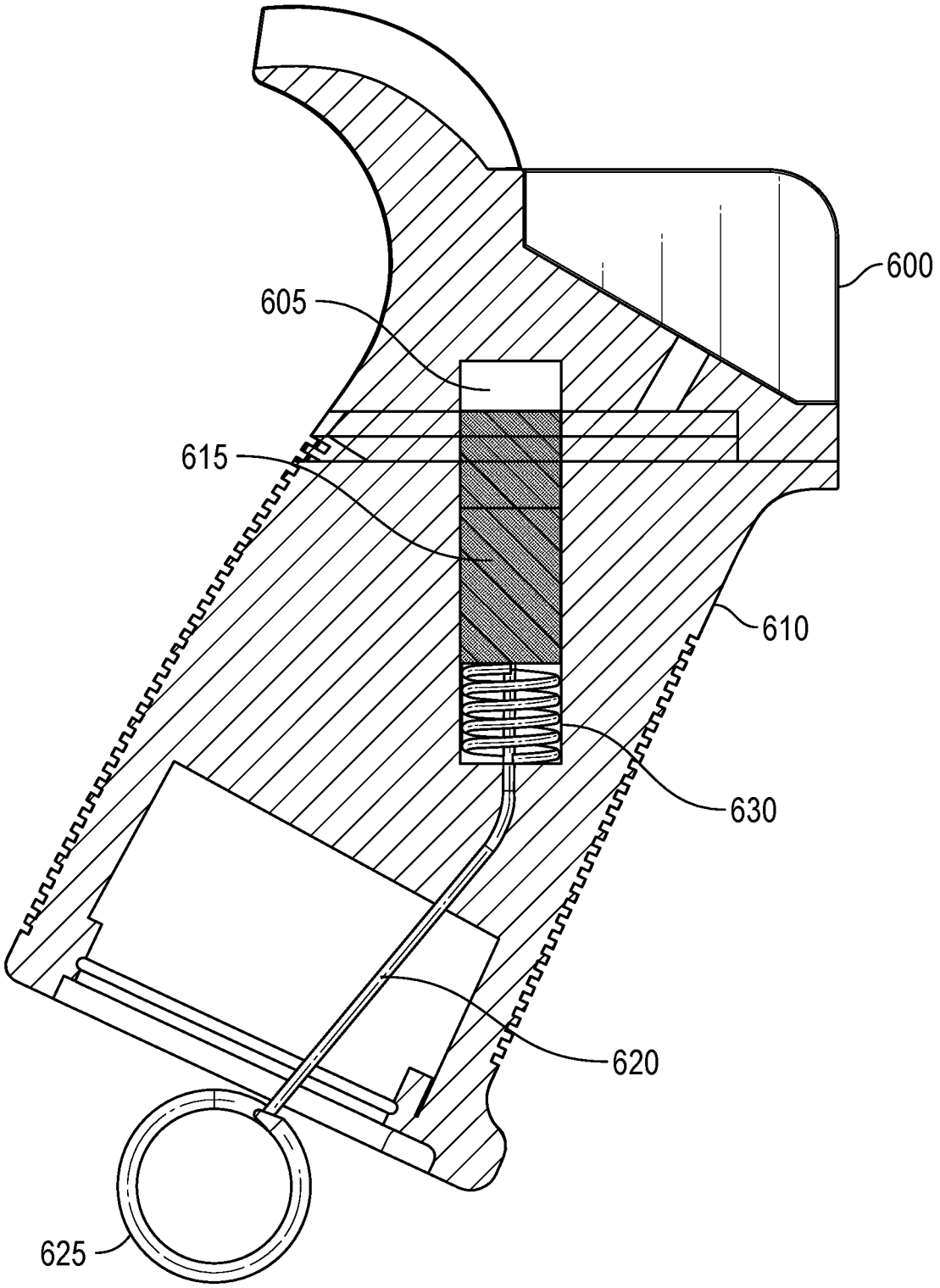
FIG. 6 shows an example of a detached interchangeable grip according to aspects of the present disclosure.

FIG. 6 shows an example of a detached interchangeable grip 610 according to aspects of the present disclosure. The example shown includes grip base piece 600 and interchangeable grip 610.

A pull release tab (e.g., a ring 625 and a flexible cable 620) may be pulled in order to lower a spring 630-loaded rod to create clearance for an interchangeable grip 610 to slide seamlessly into the grip base piece 600 via the grip interface (e.g., the T-shaped mating tab).

In some embodiments, the grip body includes a lower cavity and a release (e.g., a release tab, a ring 625 coupled to a flexible cable 620, etc.). In some examples, the release is positioned in the lower cavity and coupled to the pin 615, and a downward force applied to the release (e.g., the ring 625) results in deflection of the spring 630 and movement of the pin 615 into the second position (e.g., where in the second position the pin 615 is removed from the recess 605 and selective sliding of the interchangeable grip 610 from the grip base piece 600 is permitted). In some embodiments, the release includes a ring 625 coupled to a flexible cable 620 and the flexible cable 620 is coupled at a proximal end to the ring 625 and is coupled at a distal end to the pin 615.

Grip base piece 600 is an example of, or includes aspects of, the corresponding element described with reference to FIGS. 1-5, and 7-12. In one embodiment, grip base piece 600 includes recess 605. Interchangeable grip 610 is an example of, or includes aspects of, the corresponding element described with reference to FIGS. 1, 2, 4, 5, and 7-9. In one embodiment, interchangeable grip 610 includes pin 615, flexible cable 620, ring 625, and spring 630. Pin 615 is an example of, or includes aspects of, the corresponding element described with reference to FIG. 7. Flexible cable 620 is an example of, or includes aspects of, the corresponding element described with reference to FIG. 7. Ring 625 is an example of, or includes aspects of, the corresponding element described with reference to FIG. 7. Spring 630 is an example of, or includes aspects of, the corresponding element described with reference to FIG. 7.

Figure 7:
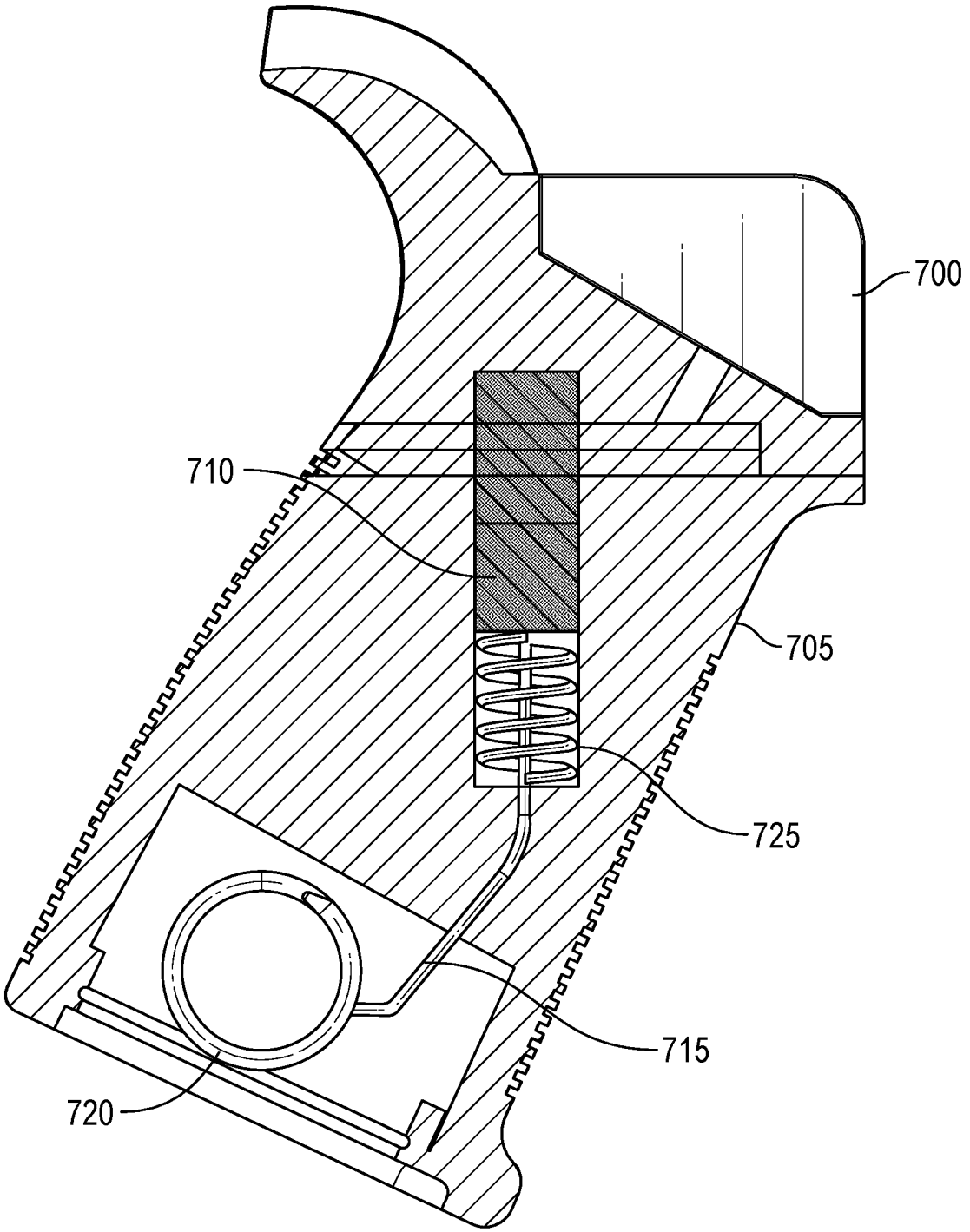
FIG. 7 shows an example of an attached interchangeable grip according to aspects of the present disclosure.

FIG. 7 shows an example of an attached interchangeable grip 705 according to aspects of the present disclosure. The example shown includes grip base piece 700 and interchangeable grip 705.

For installation, the interchangeable grip 705 may be slid through a grip base interface (e.g., a T-shaped channel) towards the barrel or front of the firearm. Once slid into place, the pull release tab may be released and a locking mechanism in the form of a spring 725-loaded rod may engage (e.g., audibly engage) in a slot (e.g., a recess) in the grip base piece 700 indicating that the two components are fastened securely. After engagement (e.g., after a user hears the audible engagement of the locking mechanism), a user may close the grip cap to prevent accidental disengagement of the pull-release tab.

Grip base piece 700 is an example of, or includes aspects of, the corresponding element described with reference to FIGS. 1-6, and 8-12. Interchangeable grip 705 is an example of, or includes aspects of, the corresponding element described with reference to FIGS. 1, 2, 4-6, 8, and 9. In one embodiment, interchangeable grip 705 includes pin 710, flexible cable 715, ring 720, and spring 725. Pin 710 is an example of, or includes aspects of, the corresponding element described with reference to FIG. 6. Flexible cable 715 is an example of, or includes aspects of, the corresponding element described with reference to FIG. 6. Ring 720 is an example of, or includes aspects of, the corresponding element described with reference to FIG. 6. Spring 725 is an example of, or includes aspects of, the corresponding element described with reference to FIG. 6.

Figure 8:
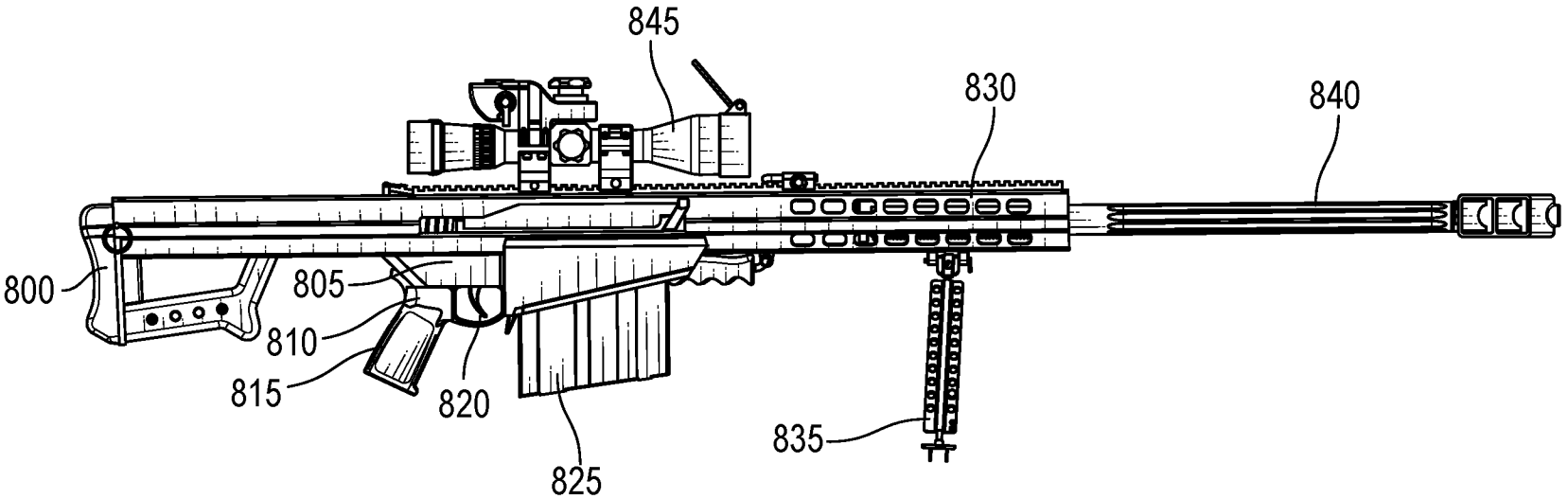
FIGS. 8 through 9 show examples of a firearm according to aspects of the present disclosure.

FIG. 8 shows an example of a firearm according to aspects of the present disclosure. The example shown includes stock 800, receiver 805, grip base piece 810, interchangeable grip 815, trigger 820, magazine 825, rail 830, foregrip 835, barrel 840, and scope 845.

Stock 800 is an example of, or includes aspects of, the corresponding element described with reference to FIGS. 1 and 9. Receiver 805 is an example of, or includes aspects of, the corresponding element described with reference to FIGS. 1-4, and 9-12. Grip base piece 810 is an example of, or includes aspects of, the corresponding element described with reference to FIGS. 1-7, and 9-12. Interchangeable grip 815 is an example of, or includes aspects of, the corresponding element described with reference to FIGS. 1, 2, 4-7, and 9. Trigger 820 is an example of, or includes aspects of, the corresponding element described with reference to FIGS. 1 and 9. Magazine 825 is an example of, or includes aspects of, the corresponding element described with reference to FIGS. 1 and 9. Rail 830 is an example of, or includes aspects of, the corresponding element described with reference to FIGS. 1 and 9. Foregrip 835 is an example of, or includes aspects of, the corresponding element described with reference to FIG. 1. Barrel 840 is an example of, or includes aspects of, the corresponding element described with reference to FIGS. 1 and 9.

Figure 9:
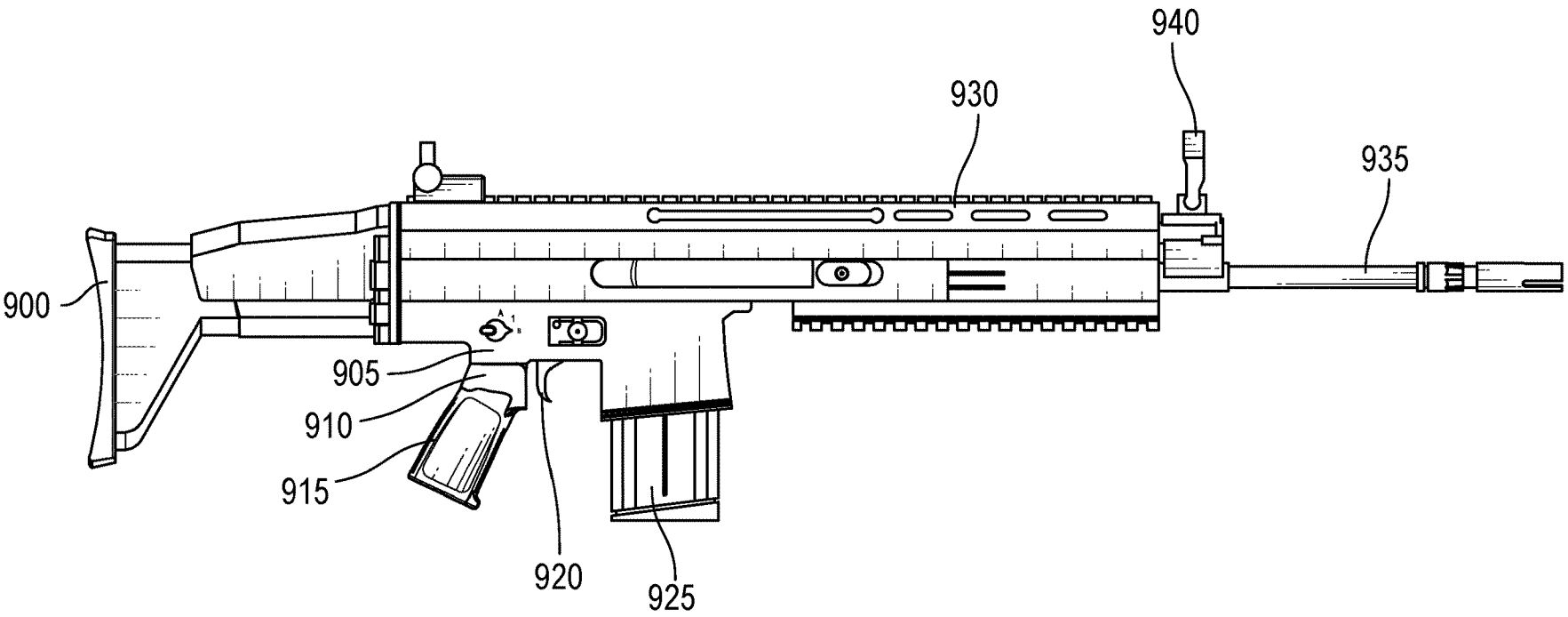

FIG. 9 shows an example of a firearm according to aspects of the present disclosure. The example shown includes stock 900, receiver 905, grip base piece 910, interchangeable grip 915, trigger 920, magazine 925, rail 930, barrel 935, and sight 940.

Stock 900 is an example of, or includes aspects of, the corresponding element described with reference to FIGS. 1 and 8. Receiver 905 is an example of, or includes aspects of, the corresponding element described with reference to FIGS. 1-4, 8, and 10-12. Grip base piece 910 is an example of, or includes aspects of, the corresponding element described with reference to FIGS. 1-8, and 10-12. Interchangeable grip 915 is an example of, or includes aspects of, the corresponding element described with reference to FIGS. 1, 2, and 4-8. Trigger 920 is an example of, or includes aspects of, the corresponding element described with reference to FIGS. 1 and 8. Magazine 925 is an example of, or includes aspects of, the corresponding element described with reference to FIGS. 1 and 8. Rail 930 is an example of, or includes aspects of, the corresponding element described with reference to FIGS. 1 and 8. Barrel 935 is an example of, or includes aspects of, the corresponding element described with reference to FIGS. 1 and 8.

Figure 10:
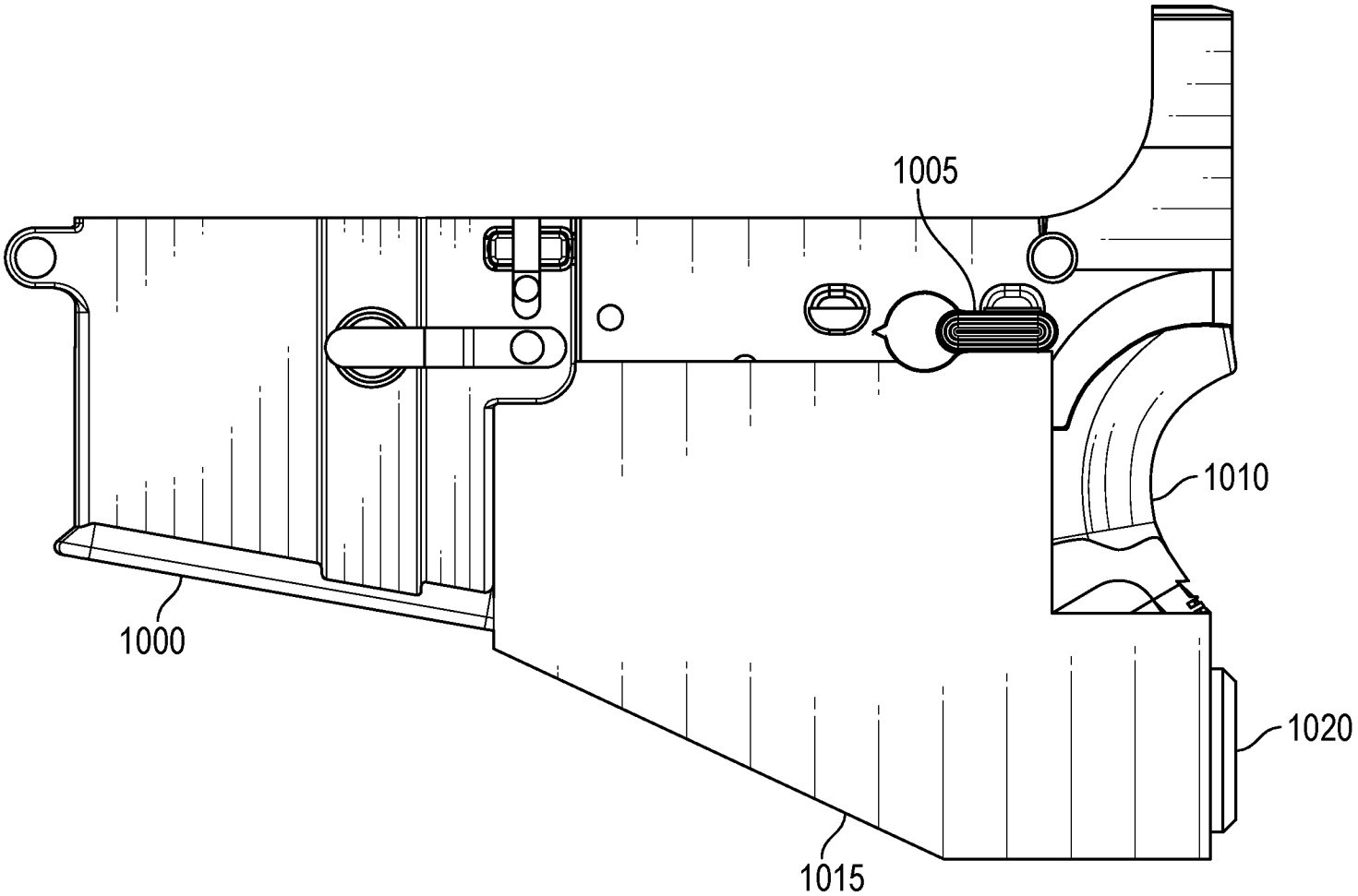
FIG. 10 shows an example of a receiver, a grip base piece, and a trigger lock according to aspects of the present disclosure.

FIG. 10 shows an example of a receiver 1000, a grip base piece 1010, and a trigger lock 1015 according to aspects of the present disclosure. The example shown includes receiver 1000, grip base piece 1010, and trigger lock 1015.

Figure 11:
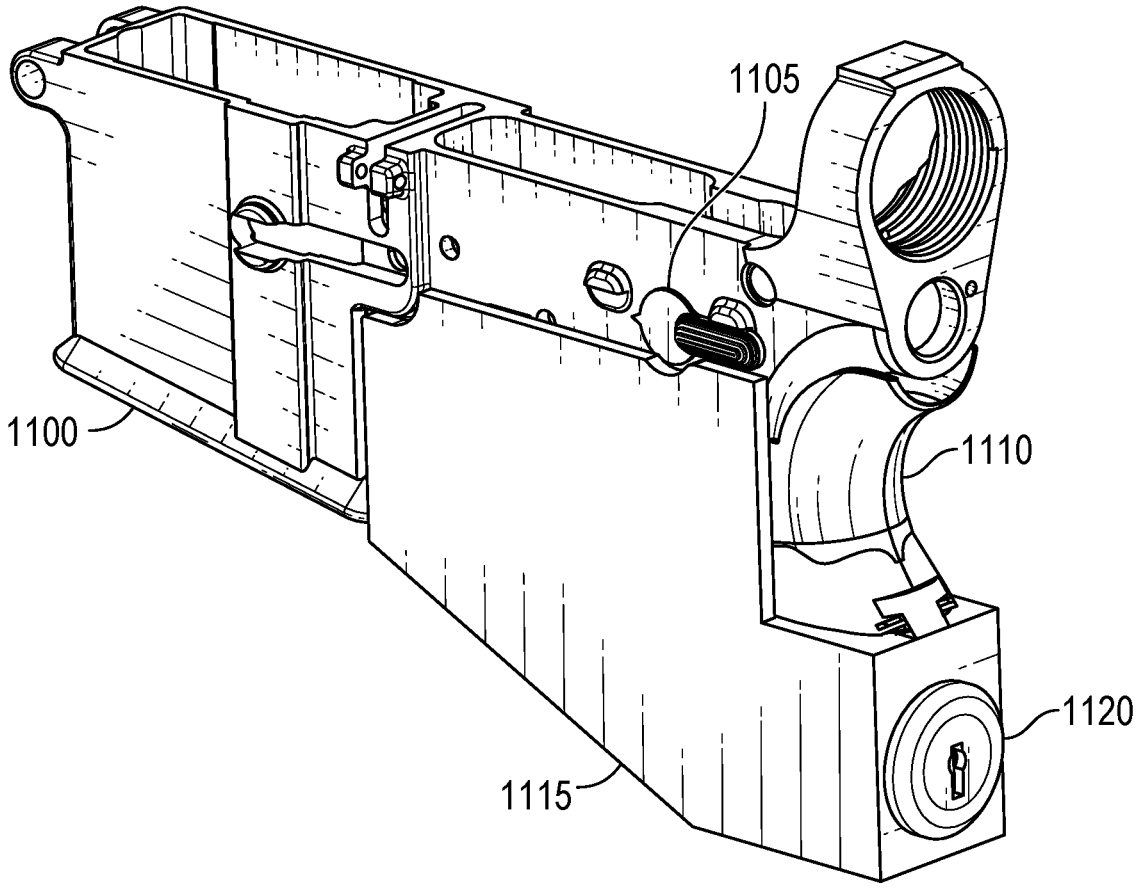
FIG. 11 shows an example of an attached trigger lock according to aspects of the present disclosure.
Figure 12:
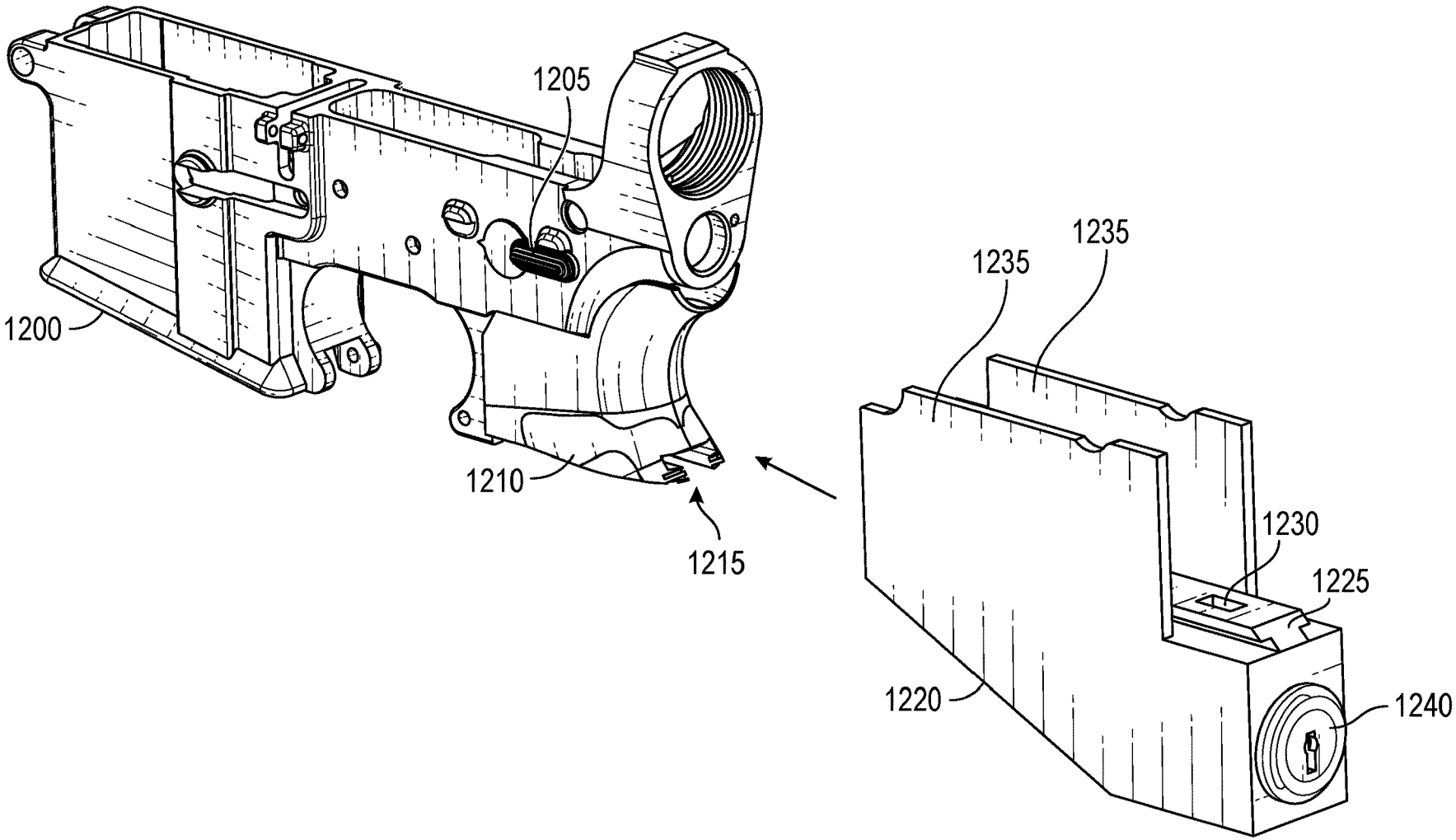
FIG. 12 shows an example of a detached trigger lock according to aspects of the present disclosure.

FIGS. 10-12 show examples of a trigger lock system for a firearm described herein. FIG. 10 shows a grip base piece 1010 including a receiver interface and a grip base interface, where the receiver interface is configured to couple to a firearm receiver 1000. In some embodiments, the receiver interface includes a base shape configured to couple to a corresponding receiver shape at a firearm grip mounting location, where the corresponding receiver shape at the firearm grip mounting location is part of the firearm receiver 1000, and where the grip base interface includes a recess. FIG. 10 also shows a trigger lock 1015 including a trigger lock interface, a trigger lock 1015 body, a trigger lock 1015 pin, and a pair of cover plates. In some examples, trigger lock 1015 may be attached to grip base piece 1010 such that the trigger lock 1015 fixes a firearm selector lever 1005 in a fixed position (e.g., in a safety position, a no fire position, a trigger lock position, etc.).

Receiver 1000 is an example of, or includes aspects of, the corresponding element described with reference to FIGS. 1-4, 8, 9, 11, and 12.

In one embodiment, receiver 1000 includes selector lever 1005. Selector lever 1005 is an example of, or includes aspects of, the corresponding element described with reference to FIGS. 11 and 12. Grip base piece 1010 is an example of, or includes aspects of, the corresponding element described with reference to FIGS. 1-9, 11, and 12. Trigger lock 1015 is an example of, or includes aspects of, the corresponding element described with reference to FIGS. 11 and 12. In one embodiment, trigger lock 1015 includes locking mechanism 1020. Locking mechanism 1020 is an example of, or includes aspects of, the corresponding element described with reference to FIGS. 11 and 12.

FIG. 11 shows an example of an attached trigger lock 1115 according to aspects of the present disclosure. The example shown includes receiver 1100, grip base piece 1110, and trigger lock 1115.

FIG. 11 shows a grip base piece 1110 including a receiver interface and a grip base interface, where the receiver interface is configured to couple to a firearm receiver 1100. In some embodiments, the receiver interface includes a base shape configured to couple to a corresponding receiver shape at a firearm grip mounting location, where the corresponding receiver shape at the firearm grip mounting location is part of the firearm receiver 1100, and where the grip base interface includes a recess. FIG. 11 also shows a trigger lock 1115 including a trigger lock interface, a trigger lock 1115 body, a trigger lock 1115 pin, and a pair of cover plates. In some examples, trigger lock 1115 may be attached to grip base piece 1110 such that the trigger lock 1115 fixes a firearm selector lever 1105 in a fixed position (e.g., in a safety position, a no fire position, a trigger lock position, etc.).

Receiver 1100 is an example of, or includes aspects of, the corresponding element described with reference to FIGS. 1-4, 8-10, and 12. In one embodiment, receiver 1100 includes selector lever 1105. Selector lever 1105 is an example of, or includes aspects of, the corresponding element described with reference to FIGS. 10 and 12. Grip base piece 1110 is an example of, or includes aspects of, the corresponding element described with reference to FIGS. 1-10, and 12. Trigger lock 1115 is an example of, or includes aspects of, the corresponding element described with reference to FIGS. 10 and 12. In one embodiment, trigger lock 1115 includes locking mechanism 1120. Locking mechanism 1120 is an example of, or includes aspects of, the corresponding element described with reference to FIGS. 10 and 12.

FIG. 12 shows an example of a detached trigger lock 1220 according to aspects of the present disclosure. The example shown includes receiver 1200, grip base piece 1210, and trigger lock 1220.

FIG. 12 shows a grip base piece 1210 including a receiver interface and a grip base interface 1215, where the receiver interface is configured to couple to a firearm receiver 1200. In some embodiments, the receiver interface includes a base shape configured to couple to a corresponding receiver shape at a firearm grip mounting location, where the corresponding receiver shape at the firearm grip mounting location is part of the firearm receiver 1200, and where the grip base interface 1215 includes a recess.

FIG. 12 also shows a trigger lock 1220 including a trigger lock interface 1225, a trigger lock 1220 body, a trigger lock 1220 pin, and a pair of cover plates 1235. The trigger lock interface 1225 is configured to couple to the grip base interface 1215. In some embodiments, the trigger lock interface 1225 includes a grip interface shape configured to couple to a corresponding grip base piece shape at a grip mounting location. In some embodiments, the grip interface shape at the grip mounting location is part of the trigger lock interface 1225 of the grip base piece 1210. In some embodiments, the trigger lock 1220 is selectively slidable at the trigger lock interface 1225 relative to the grip base interface 1215 to release the trigger lock 1220 from the grip base piece 1210, where the trigger lock 1220 body includes a trigger lock pin-guide 1230, where the trigger lock 1220 pin is disposed within the trigger lock pin-guide 1230, where the trigger lock 1220 pin protrudes into the recess of the grip base interface 1215 temporarily preventing sliding of the trigger lock interface 1225 relative to the grip base interface 1215.

In some embodiments, the pair of cover plates 1235 extend above the trigger lock 1220 body and forward over a trigger space, where one of the pair is positioned on a left side of the trigger space, and another of the pair is positioned on a right side of the trigger space, and where access to the trigger space is limited by the pair of cover plates 1235.

In some embodiments, the trigger lock system includes a spring interposed between the trigger lock 1220 body and the trigger lock 1220 pin. In some embodiments, the spring holds the trigger lock 1220 pin in a first position protruding into the recess, and where when the spring is deflected allows the trigger lock 1220 pin into a second position, removing the trigger lock 1220 pin from the recess, and permitting selective sliding of the trigger lock 1220 from the grip base piece 1210.

In some embodiments, the trigger lock system includes a lock mechanism between the trigger lock 1220 body and the trigger lock 1220 pin, where the lock mechanism holds the trigger lock 1220 pin in a first position protruding into the recess, and where when the lock mechanism is unlocked the trigger lock 1220 pin is moved into a second position, removing the trigger lock 1220 pin from the recess, and permitting selective sliding of the trigger lock 1220 from the grip base piece 1210.

In some embodiments, the trigger lock interface 1225 includes a T-shaped cross section and the grip base interface 1215 includes a T-shaped cross section. In some embodiments, the trigger lock interface 1225 includes a T-shaped cross section of a T-shaped rail extending away from the trigger lock 1220 body and the grip base interface 1215 includes a T-shaped cross section of a T-shaped channel in the grip base piece 1210. In some embodiments, the grip base piece 1210 includes a mounting hole and a fastener (e.g., a bolt), where the mounting hole is adapted to receive the fastener and the fastener couples the grip base piece 1210 to the firearm receiver 1200. In some embodiments, the grip base piece 1210 includes a lock washer encircling the bolt, where the lock washer is interposed between the bolt and the grip base piece 1210 (e.g., as described in more detail herein, for example, with reference to FIG. 3).

Receiver 1200 is an example of, or includes aspects of, the corresponding element described with reference to FIGS. 1-4, and 8-11. In one embodiment, receiver 1200 includes selector lever 1205. Selector lever 1205 is an example of, or includes aspects of, the corresponding element described with reference to FIGS. 10 and 11. Grip base piece 1210 is an example of, or includes aspects of, the corresponding element described with reference to FIGS. 1-11. In one embodiment, grip base piece 1210 includes grip base interface 1215. Grip base interface 1215 is an example of, or includes aspects of, the corresponding element described with reference to FIG. 4. Trigger lock 1220 is an example of, or includes aspects of, the corresponding element described with reference to FIGS. 10 and 11. In one embodiment, trigger lock 1220 includes trigger lock interface 1225, trigger lock pin-guide 1230, cover plate 1235, and locking mechanism 1240. Locking mechanism 1240 is an example of, or includes aspects of, the corresponding element described with reference to FIGS. 10 and 11.

Figure 13:
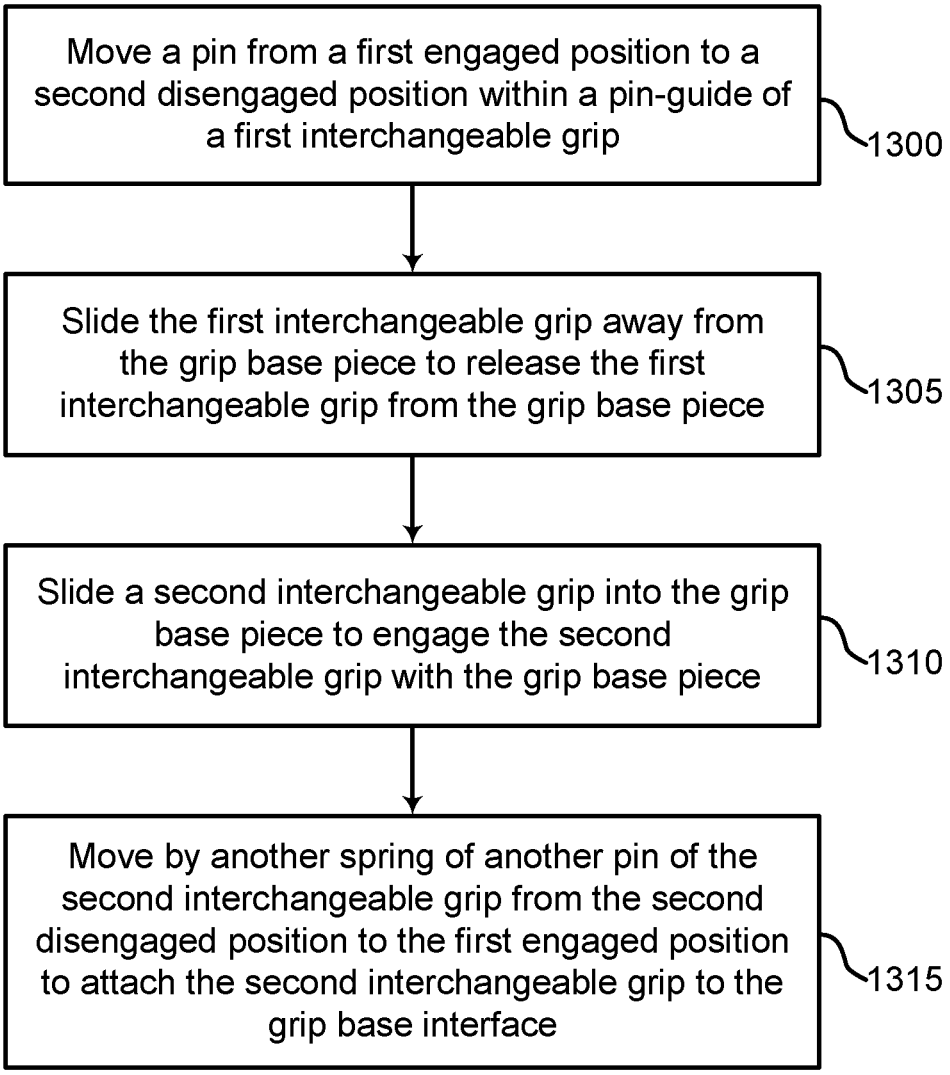
FIG. 13 shows an example of a process for interchangeable grips for firearms according to aspects of the present disclosure.

FIG. 13 shows an example of a process for interchangeable grips for firearms according to aspects of the present disclosure. In some examples, these operations are performed by a system (e.g., a firearm user). Additionally, or alternatively, certain processes are performed using special-purpose hardware described herein. Generally, these operations are performed according to the methods and processes described in accordance with aspects of the present disclosure. In some cases, the operations described herein are composed of various sub-steps, or are performed in conjunction with other operations.

At operation 1300, the system (e.g., or the user) moves a pin from a first position (e.g., an interchangeable grip engaged position) to a second position (e.g., an interchangeable grip disengaged position) within a pin-guide of a first interchangeable grip, where in a first position the pin protrudes into a recess of a grip base interface temporarily preventing sliding of a grip interface relative to the grip base interface, and where in the second position a spring is deflected to remove the pin from the recess, and permit selective sliding of the first interchangeable grip from a grip base piece. In some cases, the operations of this step refer to, or may be performed by, an interchangeable grip as described with reference to FIGS. 1, 2, and 4-9. In some cases, the operations of this step refer to, or may be performed by, a grip base piece as described with reference to FIGS. 1-12.

At operation 1305, the system (e.g., or the user) slides the first interchangeable grip from the grip base piece to release the first interchangeable grip from the grip base piece. In some cases, the operations of this step refer to, or may be performed by, a *COMPONENT as described with reference to *REF. In some cases, the operations of this step refer to, or may be performed by, an interchangeable grip as described with reference to FIGS. 1, 2, and 4-9. In some cases, the operations of this step refer to, or may be performed by, a grip base piece as described with reference to FIGS. 1-12.

At operation 1310, the system (e.g., or the user) slides a second interchangeable grip into the grip base piece to engage the second interchangeable grip with the grip base piece. In some cases, the operations of this step refer to, or may be performed by, an interchangeable grip as described with reference to FIGS. 1, 2, and 4-9. In some cases, the operations of this step refer to, or may be performed by, a grip base piece as described with reference to FIGS. 1-12.

At operation 1315, the system (e.g., or the user) moves by another spring of another pin of the second interchangeable grip from the second position to the first position within another pin-guide of the second interchangeable grip to temporarily prevent sliding of another grip interface of the second interchangeable grip relative to the grip base interface. In some cases, the operations of this step refer to, or may be performed by, an interchangeable grip as described with reference to FIGS. 1, 2, and 4-9. In some cases, the operations of this step refer to, or may be performed by, a grip base piece as described with reference to FIGS. 1-12.

Accordingly, the present disclosure includes the following embodiments.

An apparatus for interchangeable grips for firearms is described. Embodiments of the apparatus include a grip base piece comprising a receiver interface and a grip base interface, wherein the grip base piece is configured to couple to a firearm receiver, wherein the receiver interface comprises a base shape configured to couple to a corresponding receiver shape at a firearm grip mounting location, wherein the corresponding receiver shape at the firearm grip mounting location is part of the firearm receiver, and wherein the grip base interface comprises a recess and an interchangeable grip comprising a grip interface, a grip body, a pin, and a spring, wherein the grip interface is configured to couple to the grip base interface, wherein the grip interface comprises a grip interface shape configured to couple to a corresponding grip base piece shape at a grip mounting location, wherein the grip interface shape at the grip mounting location is part of the grip interface of the grip base piece, wherein the interchangeable grip is selectively slidable at the grip interface relative to the grip base interface to release the interchangeable grip from the grip base piece, wherein the grip body comprises a pin-guide, wherein the pin is disposed within the pin-guide, wherein the pin protrudes into the recess of the grip base interface temporarily preventing sliding of the grip interface relative to the grip base interface, wherein the spring is interposed between the grip body and the pin, wherein the spring holds the pin in a first position protruding into the recess, and wherein deflecting the spring allows the pin into a second position, removes the pin from the recess, and permits selective sliding of the interchangeable grip from the grip base piece.

A system for an interchangeable grip for a firearm, comprising: a grip base piece comprising a receiver interface and a grip base interface, wherein the grip base piece is configured to couple to a firearm receiver, wherein the receiver interface comprises a base shape configured to couple to a corresponding receiver shape at a firearm grip mounting location, wherein the corresponding receiver shape at the firearm grip mounting location is part of the firearm receiver, and wherein the grip base interface comprises a recess and an interchangeable grip comprising a grip interface, a grip body, a pin, and a spring, wherein the grip interface is configured to couple to the grip base interface, wherein the grip interface comprises a grip interface shape configured to couple to a corresponding grip base piece shape at a grip mounting location, wherein the grip interface shape at the grip mounting location is part of the grip interface of the grip base piece, wherein the interchangeable grip is selectively slidable at the grip interface relative to the grip base interface to release the interchangeable grip from the grip base piece, wherein the grip body comprises a pin-guide, wherein the pin is disposed within the pin-guide, wherein the pin protrudes into the recess of the grip base interface temporarily preventing sliding of the grip interface relative to the grip base interface, wherein the spring is interposed between the grip body and the pin, wherein the spring holds the pin in a first position protruding into the recess, and wherein deflecting the spring allows the pin into a second position, removes the pin from the recess, and permits selective sliding of the interchangeable grip from the grip base piece.

A method of manufacturing an apparatus for an interchangeable grip for a firearm is described. The method includes manufacturing a grip base piece comprising a receiver interface and a grip base interface, wherein the grip base piece is configured to couple to a firearm receiver, wherein the receiver interface comprises a base shape configured to couple to a corresponding receiver shape at a firearm grip mounting location, wherein the corresponding receiver shape at the firearm grip mounting location is part of the firearm receiver, and wherein the grip base interface comprises a recess and an interchangeable grip comprising a grip interface, a grip body, a pin, and a spring, wherein the grip interface is configured to couple to the grip base interface, wherein the grip interface comprises a grip interface shape configured to couple to a corresponding grip base piece shape at a grip mounting location, wherein the grip interface shape at the grip mounting location is part of the grip interface of the grip base piece, wherein the interchangeable grip is selectively slidable at the grip interface relative to the grip base interface to release the interchangeable grip from the grip base piece, wherein the grip body comprises a pin-guide, wherein the pin is disposed within the pin-guide, wherein the pin protrudes into the recess of the grip base interface temporarily preventing sliding of the grip interface relative to the grip base interface, wherein the spring is interposed between the grip body and the pin, wherein the spring holds the pin in a first position protruding into the recess, and wherein deflecting the spring allows the pin into a second position, removes the pin from the recess, and permits selective sliding of the interchangeable grip from the grip base piece.

A method of using an apparatus for an interchangeable grip for a firearm is described. The method includes using a grip base piece comprising a receiver interface and a grip base interface, wherein the grip base piece is configured to couple to a firearm receiver, wherein the receiver interface comprises a base shape configured to couple to a corresponding receiver shape at a firearm grip mounting location, wherein the corresponding receiver shape at the firearm grip mounting location is part of the firearm receiver, and wherein the grip base interface comprises a recess and an interchangeable grip comprising a grip interface, a grip body, a pin, and a spring, wherein the grip interface is configured to couple to the grip base interface, wherein the grip interface comprises a grip interface shape configured to couple to a corresponding grip base piece shape at a grip mounting location, wherein the grip interface shape at the grip mounting location is part of the grip interface of the grip base piece, wherein the interchangeable grip is selectively slidable at the grip interface relative to the grip base interface to release the interchangeable grip from the grip base piece, wherein the grip body comprises a pin-guide, wherein the pin is disposed within the pin-guide, wherein the pin protrudes into the recess of the grip base interface temporarily preventing sliding of the grip interface relative to the grip base interface, wherein the spring is interposed between the grip body and the pin, wherein the spring holds the pin in a first position protruding into the recess, and wherein deflecting the spring allows the pin into a second position, removes the pin from the recess, and permits selective sliding of the interchangeable grip from the grip base piece.

In some examples, the grip interface comprises a T-shaped cross section and the grip base interface comprises a T-shaped cross section. In some examples, the grip interface comprises a T-shaped cross section of a T-shaped rail extending away from the grip body and the grip base interface comprises a T-shaped cross section of a T-shaped channel in the grip base piece.

In some examples, the grip body further comprises a lower cavity and a release. In some examples, the release is positioned in the lower cavity and is coupled to the pin, and wherein a downward force applied to the release results in deflection of the spring and movement of the pin into the second position. In some examples, the grip body further comprises a grip cap adapted to removably cover the lower cavity. In some examples, the release comprises a ring coupled to a flexible cable. In some examples, the flexible cable is coupled at a proximal end to the ring and is coupled at a distal end to the pin.

In some examples, the grip base piece comprises a mounting hole adapted to receive a fastener that couples the grip base piece to the firearm receiver. In some examples, the quick removal grip comprises the fastener. In some examples, the fastener comprises a bolt. In some examples, the quick removal grip comprises a lock washer encircling the bolt, wherein the lock washer is interposed between the bolt and the grip base piece.

A method for interchangeable grips for firearms is described. Embodiments of the method include moving a pin from a first position to a second position within a pin-guide of a interchangeable grip, wherein in a first position the pin protrudes into a recess of a grip base interface temporarily preventing sliding of a grip interface relative to the grip base interface, and wherein in the second position a spring is deflected to remove the pin from the recess, and permit selective sliding of the interchangeable grip from a grip base piece and sliding the interchangeable grip from the grip base piece to release the interchangeable grip from the grip base piece.

Some examples of the method, apparatus, and system described above further include moving by the spring of the pin from the second position within the pin-guide.

Some examples of the method, apparatus, and system described above further include mounting the grip base piece to a firearm receiver at a grip mounting location, wherein the grip base interface is part of the grip base piece.

Some examples of the method, apparatus, and system described above further include sliding another interchangeable grip into the grip base piece to engage the other interchangeable grip with the grip base piece. Some examples further include moving by another spring of another pin from the second position to the first position within another pin-guide to temporarily prevent sliding of another grip interface relative to the grip base interface.

Some examples of the method, apparatus, and system described above further include sliding the other interchangeable grip, wherein the sliding comprises sliding of the grip interface relative to the grip base interface, wherein the grip interface and the grip base interface form a T-shaped cross section.

Some examples of the method, apparatus, and system described above further include sliding a T-shaped rail of the other interchangeable grip extending away from a grip body. Some examples further include sliding a T-shaped channel in the grip base piece, the T-shaped rail being mated with the T-shaped channel.

In some examples, the moving of the pin comprises moving a release with a force applied to the release that results in deflection of the spring and movement of the pin into the second position.

In some examples, the moving of the pin comprises removing a cover from a lower cavity of a grip body before moving the release.

In some examples, the moving of the release comprises moving a ring coupled to a flexible cable, wherein the flexible cable is coupled at a proximal end to the ring and is coupled at a distal end to the pin.

Some examples of the method, apparatus, and system described above further include mounting the grip base piece to a firearm receiver at a grip mounting location, wherein the grip base interface is part of the grip base piece.

Some examples of the method, apparatus, and system described above further include mounting the grip base piece to a firearm receiver by inserting a fastener through a mounting hole in the grip base piece and into the firearm receiver.

Some examples of the method, apparatus, and system described above further include sliding a trigger lock into the grip base piece to engage the trigger lock with the grip base piece. Some examples further include moving a trigger lock pin from the second position to the first position within a trigger lock pin-guide to temporarily prevent sliding of a trigger lock interface relative to the grip base interface.

In some examples, the sliding of the trigger lock comprises sliding of the trigger lock interface relative to the grip base interface, wherein the trigger lock interface and the grip base interface form a T-shaped cross section.

In some examples, the sliding of the trigger lock comprises sliding a T-shaped rail extending away from the trigger lock and sliding a T-shaped channel in the grip base piece, the T-shaped rail being mated with the T-shaped channel.

Some examples of the method, apparatus, and system described above further include securing the trigger lock pin with a locking mechanism to prevent moving of the trigger lock pin from the second position until the locking mechanism is unlocked.

An apparatus for interchangeable grips for firearms is described. Embodiments of the apparatus include a grip base piece comprising a receiver interface and a grip base interface, wherein the receiver interface is configured to couple to a firearm receiver, wherein the receiver interface comprises a base shape configured to couple to a corresponding receiver shape at a firearm grip mounting location, wherein the corresponding receiver shape at the firearm grip mounting location is part of the firearm receiver, and wherein the grip base interface comprises a recess and a trigger lock comprising a trigger lock interface, a trigger lock body, a trigger lock pin, and a pair of cover plates, wherein the trigger lock interface is configured to couple to the grip base interface, wherein the trigger lock interface comprises a grip interface shape configured to couple to a corresponding grip base piece shape at a grip mounting location, wherein the grip interface shape at the grip mounting location is part of the trigger lock interface of the grip base piece, wherein the trigger lock is selectively slidable at the trigger lock interface relative to the grip base interface to release the trigger lock from the grip base piece, wherein the trigger lock body comprises a trigger lock pin-guide, wherein the trigger lock pin is disposed within the trigger lock pin-guide, wherein the trigger lock pin protrudes into the recess of the grip base interface temporarily preventing sliding of the trigger lock interface relative to the grip base interface, wherein the pair of cover plates extend above the trigger lock body and forward over a trigger space, wherein one of the pair is positioned on a left side of the trigger space, and another of the pair is positioned on a right side of the trigger space, and wherein access to the trigger space is limited by the pair of cover plates.

A system for an interchangeable grip for a firearm, comprising: a grip base piece comprising a receiver interface and a grip base interface, wherein the receiver interface is configured to couple to a firearm receiver, wherein the receiver interface comprises a base shape configured to couple to a corresponding receiver shape at a firearm grip mounting location, wherein the corresponding receiver shape at the firearm grip mounting location is part of the firearm receiver, and wherein the grip base interface comprises a recess and a trigger lock comprising a trigger lock interface, a trigger lock body, a trigger lock pin, and a pair of cover plates, wherein the trigger lock interface is configured to couple to the grip base interface, wherein the trigger lock interface comprises a grip interface shape configured to couple to a corresponding grip base piece shape at a grip mounting location, wherein the grip interface shape at the grip mounting location is part of the trigger lock interface of the grip base piece, wherein the trigger lock is selectively slidable at the trigger lock interface relative to the grip base interface to release the trigger lock from the grip base piece, wherein the trigger lock body comprises a trigger lock pin-guide, wherein the trigger lock pin is disposed within the trigger lock pin-guide, wherein the trigger lock pin protrudes into the recess of the grip base interface temporarily preventing sliding of the trigger lock interface relative to the grip base interface, wherein the pair of cover plates extend above the trigger lock body and forward over a trigger space, wherein one of the pair is positioned on a left side of the trigger space, and another of the pair is positioned on a right side of the trigger space, and wherein access to the trigger space is limited by the pair of cover plates.

A method of manufacturing an apparatus for an interchangeable grip for a firearm is described. The method includes manufacturing a grip base piece comprising a receiver interface and a grip base interface, wherein the receiver interface is configured to couple to a firearm receiver, wherein the receiver interface comprises a base shape configured to couple to a corresponding receiver shape at a firearm grip mounting location, wherein the corresponding receiver shape at the firearm grip mounting location is part of the firearm receiver, and wherein the a grip base interface comprises a recess and a trigger lock comprising a trigger lock interface, a trigger lock body, a trigger lock pin, and a pair of cover plates, wherein the trigger lock interface is configured to couple to the grip base interface, wherein the trigger lock interface comprises a grip interface shape configured to couple to a corresponding grip base piece shape at a grip mounting location, wherein the grip interface shape at the grip mounting location is part of the trigger lock interface of the grip base piece, wherein the trigger lock is selectively slidable at the trigger lock interface relative to the grip base interface to release the trigger lock from the grip base piece, wherein the trigger lock body comprises a trigger lock pin-guide, wherein the trigger lock pin is disposed within the trigger lock pin-guide, wherein the trigger lock pin protrudes into the recess of the grip base interface temporarily preventing sliding of the trigger lock interface relative to the grip base interface, wherein the pair of cover plates extend above the trigger lock body and forward over a trigger space, wherein one of the pair is positioned on a left side of the trigger space, and another of the pair is positioned on a right side of the trigger space, and wherein access to the trigger space is limited by the pair of cover plates.

A method of using an apparatus for an interchangeable grip for a firearm is described. The method includes using a grip base piece comprising a receiver interface and a grip base interface, wherein the receiver interface is configured to couple to a firearm receiver, wherein the receiver interface comprises a base shape configured to couple to a corresponding receiver shape at a firearm grip mounting location, wherein the corresponding receiver shape at the firearm grip mounting location is part of the firearm receiver, and wherein the grip base interface comprises a recess and a trigger lock comprising a trigger lock interface, a trigger lock body, a trigger lock pin, and a pair of cover plates, wherein the trigger lock interface is configured to couple to the grip base interface, wherein the trigger lock interface comprises a grip interface shape configured to couple to a corresponding grip base piece shape at a grip mounting location, wherein the grip interface shape at the grip mounting location is part of the trigger lock interface of the grip base piece, wherein the trigger lock is selectively slidable at the trigger lock interface relative to the grip base interface to release the trigger lock from the grip base piece, wherein the trigger lock body comprises a trigger lock pin-guide, wherein the trigger lock pin is disposed within the trigger lock pin-guide, wherein the trigger lock pin protrudes into the recess of the grip base interface temporarily preventing sliding of the trigger lock interface relative to the grip base interface, wherein the pair of cover plates extend above the trigger lock body and forward over a trigger space, wherein one of the pair is positioned on a left side of the trigger space, and another of the pair is positioned on a right side of the trigger space, and wherein access to the trigger space is limited by the pair of cover plates.

Some examples of the apparatus, system, and method described above further include a spring interposed between the trigger lock body and the trigger lock pin, wherein the spring holds the trigger lock pin in a first position protruding into the recess, and wherein deflecting the spring allows the trigger lock pin into a second position, removes the trigger lock pin from the recess, and permits selective sliding of the trigger lock from the grip base piece.

Some examples of the apparatus, system, and method described above further include a lock mechanism between the trigger lock body and the trigger lock pin, wherein the lock mechanism holds the trigger lock pin in a first position protruding into the recess, and wherein when the lock mechanism is unlocked the trigger lock pin is moved into a second position, the second position removing the trigger lock pin from the recess and permitting selective sliding of the trigger lock from the grip base piece.

In some examples, the trigger lock interface comprises a T-shaped cross section and the grip base interface comprises a T-shaped cross section.

In some examples, the trigger lock interface comprises a T-shaped cross section of a T-shaped rail extending away from the trigger lock body and the grip base interface comprises a T-shaped cross section of a T-shaped channel in the grip base piece.

In some examples, the grip base piece comprises a mounting hole and a fastener.

In some examples, the mounting hole is adapted to receive the fastener and the fastener couples the grip base piece to the firearm receiver.

In some examples, the fastener comprises a bolt.

In some examples, the grip base piece comprises a lock washer encircling the bolt, wherein the lock washer is interposed between the bolt and the grip base piece.

While the invention herein disclosed has been described by means of specific embodiments, examples and applications thereof, numerous modifications and variations could be made thereto by those skilled in the art without departing from the scope of the invention set forth in the claims.

What is claimed is:

1. A quick removal grip for a firearm, comprising:

a grip base piece comprising:

a receiver interface configured to couple to a firearm receiver, wherein the receiver interface comprises a base shape configured to couple to a corresponding receiver shape at a firearm grip mounting location, wherein the corresponding receiver shape at the firearm grip mounting location is part of the firearm receiver; and a grip base interface comprising a recess; and an interchangeable grip comprising:

a grip interface configured to couple to the grip base interface, wherein the grip interface comprises a grip interface shape configured to couple to a corresponding grip base piece shape at a grip mounting location, wherein the grip interface shape at the grip mounting location is part of the grip interface of the grip base piece, wherein the interchangeable grip is selectively slidable at the grip interface relative to the grip base interface to release the interchangeable grip from the grip base piece;

a grip body comprising a pin-guide, a lower cavity, and a release;

a pin disposed within the pin-guide, wherein the pin protrudes into the recess of the grip base interface temporarily preventing sliding of the grip interface relative to the grip base interface; and a spring interposed between the grip body and the pin, wherein the spring holds the pin in a first position protruding into the recess, and wherein when the spring is deflected allows the pin into a second position, removing the pin from the recess, and permitting selective sliding of the interchangeable grip from the grip base piece, the release of the grip body comprising a ring coupled to a flexible cable, wherein the flexible cable is coupled at a proximal end to the ring and is coupled at a distal end to said pin positioned in the lower cavity and coupled to the pin, said release positioned in the lower cavity and coupled to the pin, wherein a downward force applied to the release results in deflection of the spring and movement of the pin into the said second position.

2. The quick removal grip of claim 1, comprising:

said grip interface, wherein said grip interface comprises a T-shaped cross section; and said grip base interface, wherein said grip base interface comprises a T-shaped cross section.

3. The quick removal grip of claim 2, comprising:

said grip interface, wherein said grip interface comprises said T-shaped cross section of a T-shaped rail extending away from said grip body; and said grip base interface, wherein said grip base interface comprises said T-shaped cross section of a T-shaped channel in said grip base piece.

4. The quick removal grip of claim 1, comprising:

a grip cap adapted to removably cover said lower cavity.

5. The quick removal grip of claim 1, comprising:

said grip base piece comprising:

a mounting hole adapted to receive a fastener that couples the grip base piece to said firearm receiver.

6. The quick removal grip of claim 5, comprising:

said fastener.

7. The quick removal grip of claim 6, comprising:

said fastener, wherein said fastener comprises a bolt.

8. The quick removal grip of claim 7, comprising:

a lock washer encircling said bolt, wherein said lock washer is interposed between said bolt and said grip base piece.

* * * * *